US008157679B2

(12) United States Patent
Cyr et al.

(10) Patent No.: US 8,157,679 B2
(45) Date of Patent: Apr. 17, 2012

(54) GAME ANIMAL ESCAPE IMPEDANCE DEVICE

(76) Inventors: Maurice Cyr, Hampden, ME (US); Jon Simms, Hampden, ME (US)

( * ) Notice: Subject to any disclaimer, the term of this patent is extended or adjusted under 35 U.S.C. 154(b) by 234 days.

(21) Appl. No.: 12/579,095

(22) Filed: Oct. 14, 2009

(65) Prior Publication Data

US 2010/0137080 A1 Jun. 3, 2010

Related U.S. Application Data

(63) Continuation-in-part of application No. 11/697,165, filed on Apr. 5, 2007, now abandoned.

(51) Int. Cl.
*F42B 6/04* (2006.01)

(52) U.S. Cl. ..... 473/578

(58) Field of Classification Search ..... 43/6; 473/578, 473/582, 583, 584, 585, 586
See application file for complete search history.

(56) References Cited

U.S. PATENT DOCUMENTS

| | | | | |
|---|---|---|---|---|
| 2,568,417 | A * | 9/1951 | Steinbacher | 473/583 |
| 4,651,999 | A | 3/1987 | Sturm | |
| 4,795,165 | A | 1/1989 | Tehan | |
| 4,836,557 | A | 6/1989 | Polando | |
| 5,100,143 | A * | 3/1992 | Puckett | 473/583 |
| 5,427,384 | A | 6/1995 | Saunders | |
| 5,496,041 | A | 3/1996 | Broussard | |
| 5,553,413 | A * | 9/1996 | Gannon | 43/6 |
| 6,200,237 | B1 * | 3/2001 | Barrie | 473/583 |
| 6,517,453 | B2 | 2/2003 | LaSee | |
| 6,755,758 | B2 * | 6/2004 | Liechty, II | 473/583 |
| 7,331,886 | B2 | 2/2008 | Morris et al. | |

* cited by examiner

*Primary Examiner* — John Ricci
(74) *Attorney, Agent, or Firm* — Anthony D. Pellegrini, Esq.

(57) ABSTRACT

A projectile-based system for impeding the escape of a game animal, whereby the projectile is an arrow or a crossbow bolt, the system comprising an environmental engagement device, a retention device, and a tether, with the environmental engagement device suitably adapted to pass through the game animal and thereafter to engage with the environment, the retention device suitably adapted to engage with the game animal and become secured thereto, and the tether suitably adapted to attach the environmental engagement device to the retention device, the tether being suitably adapted to withstand without breaking the forces applied by the game animal to the tether in the course of attempting an escape, thereby retaining the game animal to the environmental engagement device, whereby the engagement of the environmental engagement device with the environment substantially impedes the escape of the game animal.

21 Claims, 5 Drawing Sheets

GAME ANIMAL ESCAPE IMPEDANCE DEVICE

CROSS REFERENCE TO RELATED APPLICATION

This application is a continuation in part of U.S. Ser. No. 11/697,165, filed Apr. 5, 2007 now abandoned, entitled Game Animal Escape Impedance Device, by Cyr, Maurice, et al., which is hereby incorporated by reference.

BACKGROUND OF THE INVENTION

1. Technical Field

The present invention relates generally to the field of bow hunting for game animals and more particularly to the use of a device used in combination with an arrow or crossbow bolt to impede the escape of a wounded game animal.

2. Description of Prior Art

Within the sport of bow hunting, recovery of the game animal after the shot is often a challenge. It is common for a game animal to survive an initial strike by a projectile, such as an arrow or a crossbow bolt, whereby it then attempts to escape from the hunter. An escaped, injured game animal may travel a great distance; if it is not quickly retrieved it may be lost to the hunter forever. While some injured animals may recover, many more die slow, lingering deaths. Thus the imperative for tracking and retrieving game animals shot with a projectile. Traditional means for tracking and retrieving an injured game animal involve observing the impact of the escaping game animal on the environment, such as leaving tracks, disturbing vegetation, and the like. An injured animal also often leaves a blood trail from the wound or wounds caused by the projectile, and this can be followed. However, some game animals, such as wild turkeys, typically do not leave a blood trail. Wild turkeys can also fly, making environmental tracking that much more difficult.

The field of bow hunting for game animals is therefore replete with systems designed to assist the hunter in tracking or retrieving a game animal successfully shot with a projectile. These range from the basic, such as an arrow trailing a string, to the quirky, such as arrows which trail smoke or emit a blinking light signal or a specific odor, to the technologically advanced, such as arrow-borne electronic homing devices. However, none of these devices addresses the basic issue of the game animal making its initial escape.

In the subfield of bow fishing, the prior art teaches the use of arrows with trailing fishing line, so that a fish struck with an arrow can be retrieved. The trailing line used is typically attached to the arrow at one end and a reel or anchor or flotation device at the other end; once the fish is struck by the arrow, the fisherman draws in the line, retrieving the fish. While this does address the escape of the fish, it is not practically applicable to hunting terrestrial game animals. Typically, the range for bow fishing is far less than for other types of bow hunting, and an arrow trailing a line in flight is far less accurate.

There is therefore a need for a projectile-based system for impeding the initial escape of a terrestrial-based game animal struck by said projectile, whereby the system does not compromise the range or accuracy of the projectile.

It is therefore an objective of this invention to provide a projectile-based system for impeding the escape of a game animal.

It is a further objective of this invention to provide a projectile-based system for impeding the escape of a game animal having a minimum impact on the range and accuracy of the projectile in flight.

It is yet a further objective of this invention to provide a projectile-based system for impeding the escape of a game animal which is easy to use in the field.

It is yet a further objective of this invention to provide a projectile-based system for impeding the escape of a game animal which is inexpensive to manufacture.

It is yet a further objective of this invention to provide a projectile-based system for impeding the escape of a game animal which allows bow hunters to use their preferred model of shaft, fletching, and arrowhead.

It is yet a further objective of this invention to provide a projectile-based system for impeding the escape of a game animal which increases blunt traumatic forces to the game animal, thereby limiting its ability to escape and potentially hastening its dispatch.

Other objectives of this invention will be evident from the following disclosure.

SUMMARY

The present invention is directed to a projectile-based system for use when bow hunting for impeding the escape of a game animal. The projectile may be either an arrow that is shot with a bow, or a bolt that is shot with a crossbow. The system comprises an environmental engagement device, a retention device, and a tether. When the projectile strikes a game animal, the environmental engagement device deploys and engages with the environment, such as the ground, bushes, trees, rocks, shrubs, and the like, becoming substantially entangled with, attached to, hooked on, or otherwise secured thereto. The retention device is suitably adapted to engage with the game animal and become secured thereto. The tether is suitably adapted to attach the environmental engagement device to the retention device. As such, the tether retains the environmental engagement device to the game animal. Thus, the system is seen to impede the escape of a game animal by attaching the game animal to the environmental engagement device and engaging the environmental engagement device with the environment, thereby causing the game animal to become engaged with the environment and impeding its escape.

The present invention may also increase the blunt force trauma that is inflicted on a game animal. Small game animals are often propelled some distance upon being struck by a projectile. With the present invention, upon the engagement device engaging with the environment, the forward motion of the game animal is abruptly halted, usually accompanied by the game animal being forced to the ground. These rapid re-directional forces increase the blunt trauma to the game animal, further hindering its ability to escape.

In one embodiment the environmental engagement device is a combination of a removably attached arrowhead and a portion of the tether. In this embodiment, the environmental engagement device deploys with the detachment of the arrowhead from the projectile, with the arrowhead and a portion of the tether engaging with the environment.

In another embodiment the environmental engagement device is a combination of the projectile and a portion of the tether. In this embodiment, the projectile comprises a detachable nock, which serves as the retention device. The environmental engagement device deploys with the detachment of the detachable nock from the projectile, with the entire projectile and a portion of the tether engaging with the environment.

In yet another embodiment the environmental engagement device is a combination of the arrowhead, the projectile, and a portion of the tether. In this embodiment, the projectile comprises both a removably attached arrowhead and a detachable nock. The environmental engagement device deploys with the detachment of the arrowhead from the projectile and the detachment of the projectile from the detachable nock, with the projectile, the arrowhead, and a portion of the tether engaging with the environment.

In yet another embodiment the system comprises an environmental engagement device and a retention device, but does not include a tether. In such an embodiment, the forward portion of the projectile passes through the game animal and causes the environmental engagement device to deploy, engaging the environment while still attached to the projectile.

Other features and advantages of the invention are described below.

DETAILED DESCRIPTION OF THE INVENTION

Figure 1:
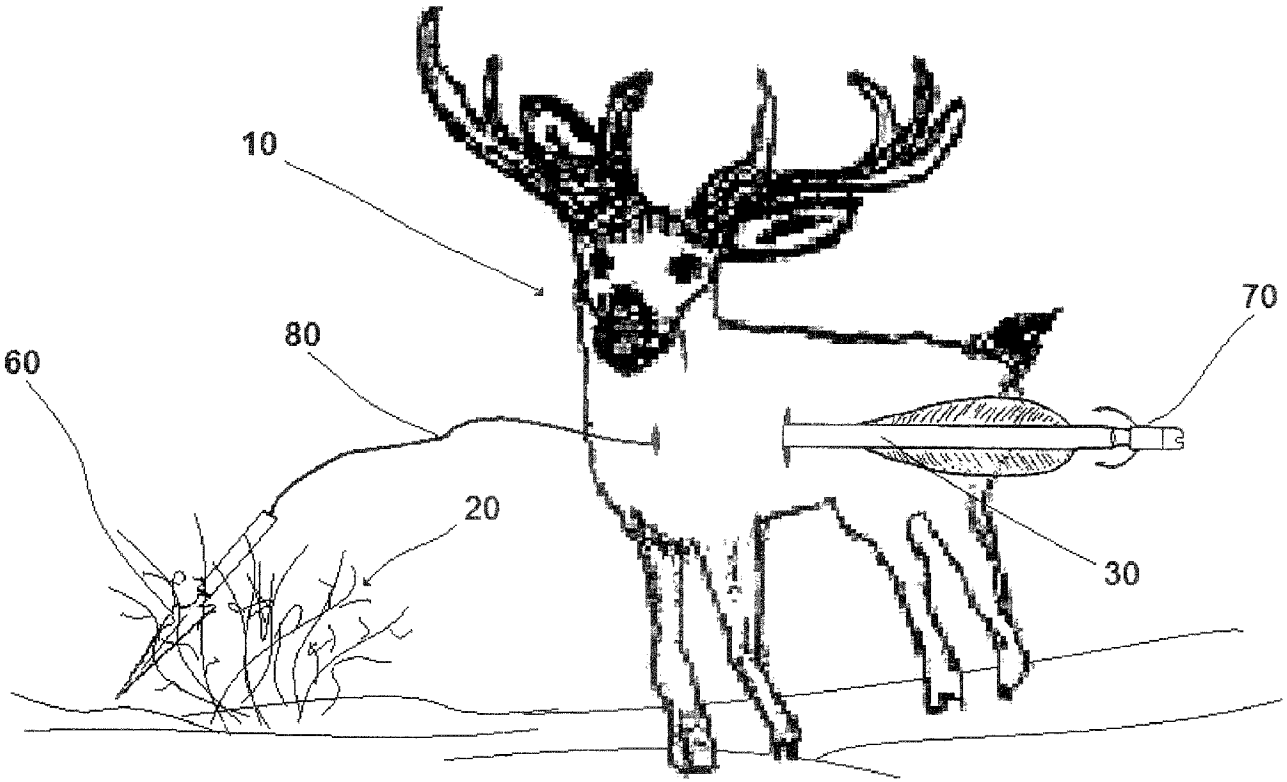
FIG. 1 shows the projectile-based system for impeding the escape of a game animal in use, with the environmental engagement device deployed and engaged with the environment (for clarity the projectile and retention device are shown enlarged, and the retention device is not shown engaged with the game animal).
Figure 2:
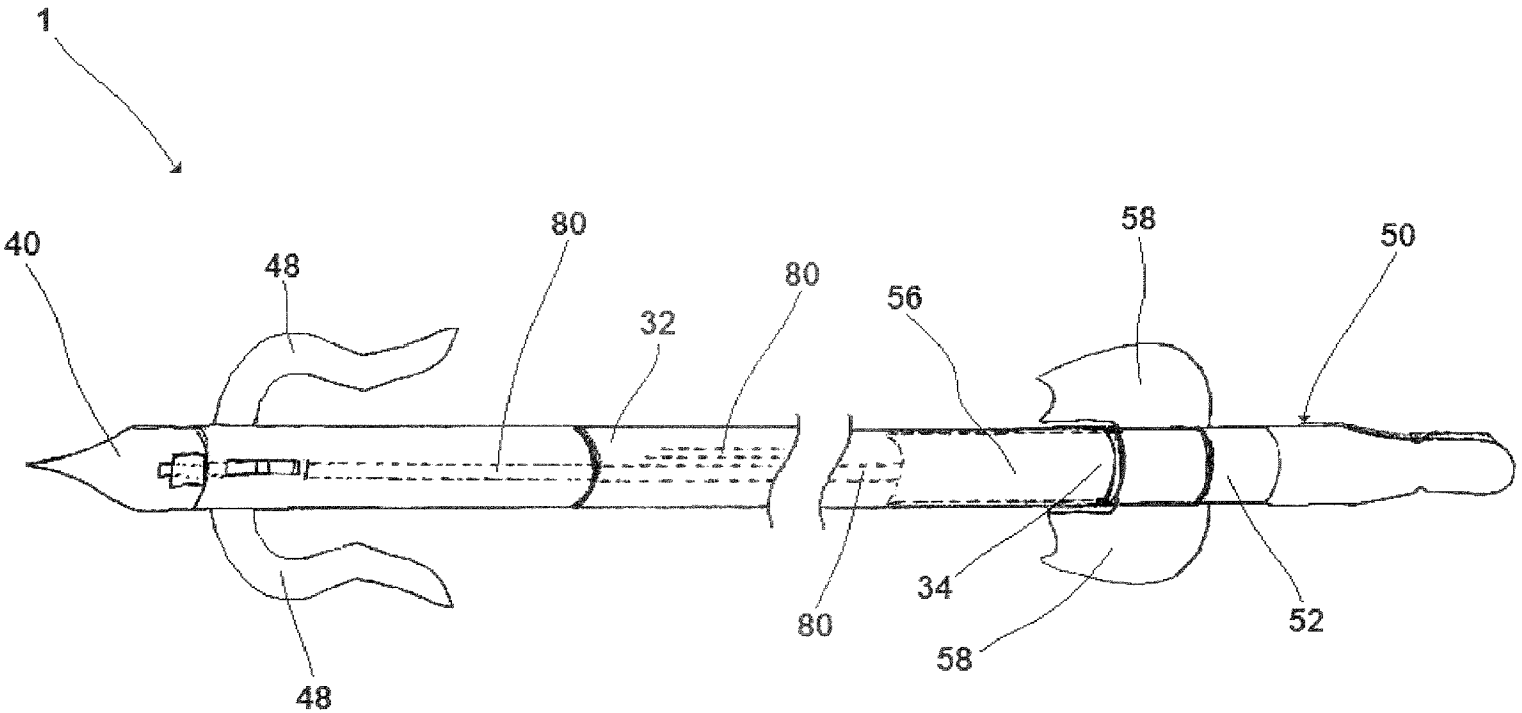
FIG. 2 is a plan view of the projectile-based system for impeding the escape of a game animal depicting the tether in ghost lines contained within the projectile shaft.

The present invention comprises an environmental engagement device 60, a retention device 70, and a tether 80. See FIG. 2. The environmental engagement device 60 is suitably adapted to be deployed upon the projectile 30 striking the game animal 10 and thereafter to engage with the environment 20. See FIG. 1. The retention device 70 is suitably adapted to engage with the game animal 10 and become secured thereto. The retention device 70 may be a penetration limiter located at the back end 34 of the projectile 30. The tether 80 is suitably adapted to attach the environmental engagement device 60 to the retention device 70. In the preferred embodiment the length of the tether 80 is less than four times the length of the projectile 30. The elimination of excess amounts of tether 80 prevents the game animal 10 from building momentum before becoming impeded by the tether 80, thereby maximizing the retention properties of the system.

The environmental engagement device 60 is suitably adapted to pass through the game animal 10 and thereafter to engage with the environment 20. It is contemplated that the environmental engagement device 60 may have multiple configurations. In one embodiment, where the projectile 30 comprises an arrowhead 40, the environmental engagement device 60 is comprised of the arrowhead 40 and portions of the tether 80. In this embodiment the arrowhead 40 is removably attached to the front end 32 of the projectile 30 and the tether 80 is attached at one end to the arrowhead 40 and at the other end to the projectile 30, and the retention device 70 is located at the back end 34 of the projectile 30. The arrowhead 40 may be a broad head for use with larger game or a point for use with smaller game. Other styles of arrowhead 40 are also contemplated by the present invention.

In this embodiment the environmental engagement device 60 is deployed when the arrowhead 40 is removed from the projectile 30 by inertial forces acting on the arrowhead 40 upon the game animal 10 being struck by the projectile 30. That is, upon impact of the projectile 30 with the game animal 10, the forward motion of the projectile 30 becomes slowed or stopped relative to the forward motion of the arrowhead 40 by reason of the retention device 70 engaging with the game animal 10. This causes the arrowhead 40, which has passed through the game animal 10, to separate from the projectile 30 and continue its forward motion, drawing at least a portion of the tether 80 with it. The arrowhead 40 and a portion of the tether 80 are now free from the projectile 30 and the game animal 10 and are able to engage with the environment 20 as the game animal 10 attempts to escape.

In another embodiment the projectile 30 comprises a detachable nock 50, with the environmental engagement device 60 comprised of portions of the tether 80 and the projectile 30. In this embodiment, the detachable nock 50 is removably attached to the back end 34 of the projectile 30, and the tether 80 is attached at one end to the detachable nock 50 and at the other end to the projectile 30. In this embodiment the detachable nock 50 serves as the retention device 70.

In this embodiment the environmental engagement device 60 is deployed when the projectile 30 is removed from the detachable nock 50 by inertial forces acting on the projectile 30 upon the game animal 10 being struck by the projectile 30. That is, upon impact of the projectile 30 with the game animal 10, the forward motion of the detachable nock 50 becomes slowed or stopped relative to the forward motion of the projectile 30 by reason as the detachable nock 50 engages with the game animal 10. This causes the projectile 30 to separate from the detachable nock 50 and continue its forward motion, passing through the game animal 10 and drawing at least a portion of the tether 80 with it. The projectile 30 and a portion of the tether 80 are now free from the game animal 10 and are able to engage with the environment 20 as the game animal 10 attempts to escape.

Figure 3:
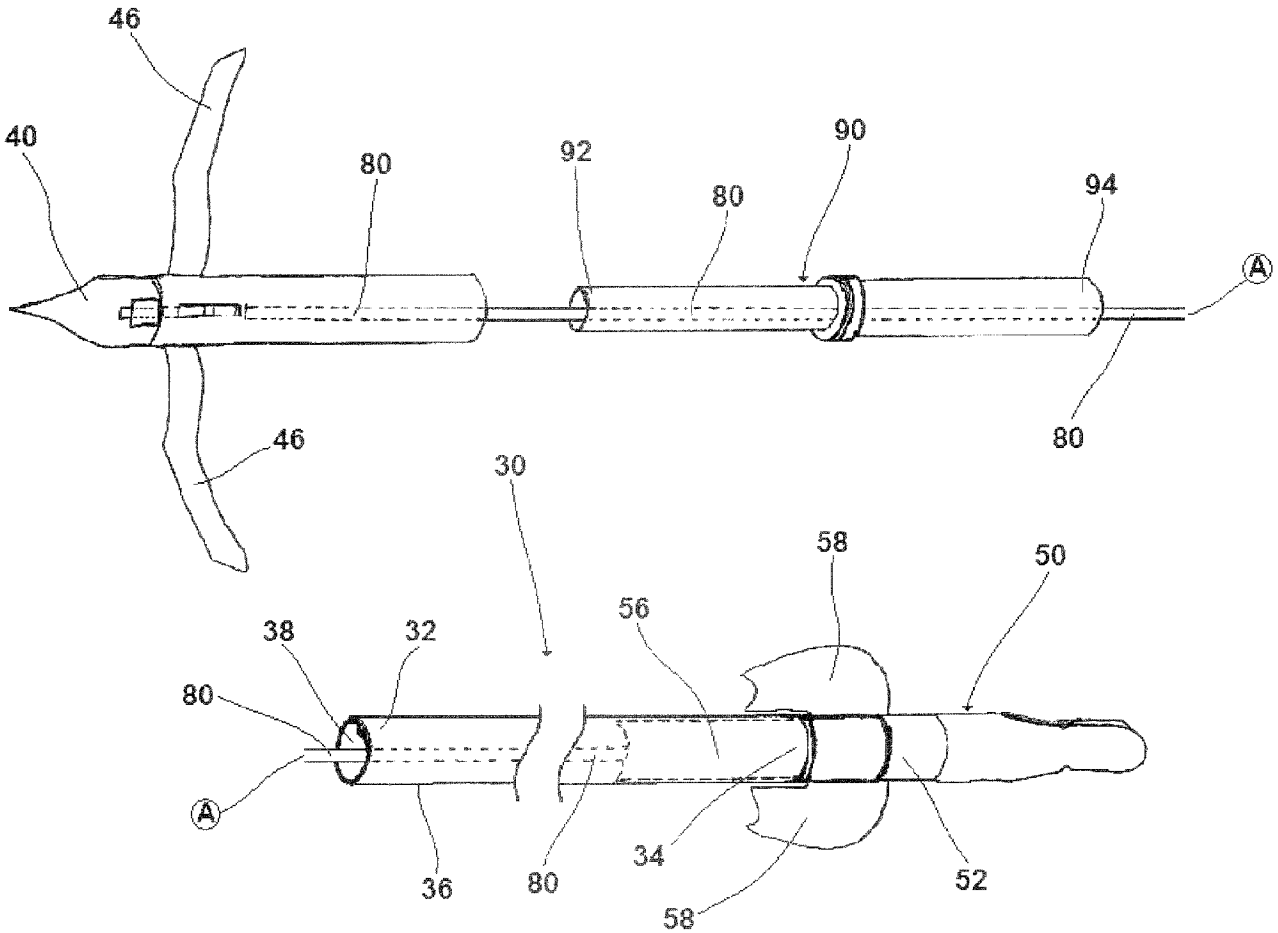
FIG. 3 is an exploded plan view of the projectile-based system for impeding the escape of a game animal having a presert.

In yet another embodiment the projectile 30 comprises both an arrowhead 40 and a detachable nock 50. See FIG. 3. The arrowhead 40 is removably attached to the front end 32 of the projectile 30, and the detachable nock 50, which serves as the retention device 70, is removably attached to the back end 34 of the projectile 30. The tether 80 is attached at one end to the detachable nock 50 and at the other end to the arrowhead 40. In this embodiment, the environmental engagement device 60 is comprised of the arrowhead 40, the projectile 30, and portions of the tether 80.

In this embodiment the environmental engagement device 60 is deployed when the arrowhead 40 is removed from the projectile 30 by inertial forces acting on the arrowhead 40 as described above, or the projectile 30 is removed from the detachable nock 50 by inertial forces action on the projectile 30 as described above, or both. The arrowhead 40 and a portion of the tether 80, and potentially also the projectile 30, are now free from the game animal 10 and are able to engage with the environment 20 as the game animal 10 attempts to escape.

The tether 80 must be able to withstand without breaking the forces applied by the game animal 10 to the tether in the course of its attempting an escape. In one embodiment the tether 80 is made of braided Dacron. In the preferred embodiment the tether 80 is longer than the length of the shaft of the projectile 30, preferably from two times to four times the length of the shaft. In the most preferred embodiment, the tether 80 is coated with a wax. This stiffens the tether 80, making it easier to insert into the hollow shaft 36 of the projectile 30, obviating the need for a separate push rod device. The wax also serves to waterproof the tether 80.

In each of the foregoing embodiments the projectile 30 may have a hollow shaft 36, within which the tether 80 is stored prior to deployment. As the arrowhead 40 separates from the projectile 30, or the projectile 30 separates from the detachable nock 50, the tether 80 is pulled out of the hollow shaft 36 of the projectile 30. This configuration securely retains the tether 80 prior to deployment, preventing the tether 80 from becoming entangled or otherwise interfering with the use or storage of the projectile 30. More importantly, with the tether 80 contained within the hollow shaft 36 of the projectile 30, the tether 80 does not interfere with the flight of the projectile 30.

In the embodiments of the present invention comprising an arrowhead 40, the arrowhead 40 may be frictionally attached to the front end 32 of the projectile 30, mechanically attached to the front end 32 of the projectile 30, or magnetically attached to the front end 32 of the projectile 30. In any such configuration, the attachment mechanism must be suitably secure to retain the arrowhead 40 to the projectile 30 during the flight of the projectile 30, but must be overcome by the inertial forces acting on the arrowhead 40 upon the game animal 10 being struck with the projectile 30. In one embodiment, a frictional attachment is achieved by the use of a post depending from the posterior of the arrowhead 40, said post suitably adapted to be snugly inserted into an aperture 38 located at the front end 32 of the projectile 30. In another embodiment, a frictional attachment is achieved by the use of a sleeve depending from the posterior of the arrowhead 40, said sleeve suitably adapted to snugly fit over the front end 32 of the projectile 30. In yet another embodiment, a mechanical attachment is achieved by the use of a post depending from the posterior of the arrowhead 40, said post suitably adapted to be inserted into an aperture 38 located at the front end 32 of the projectile 30, said post having an annular projection adapted to fit into an annular depression formed within the aperture 38 of the projectile 30. In yet another embodiment the annular projection may be formed within the aperture 38 of the projectile 30 and the annular depression is formed into the post. In yet another embodiment a mechanical attachment is achieved by fitting a sleeve depending from the posterior of the arrowhead 40 as described above with an internal annular projection, adapted to fit into an external annular depression formed in the surface of the front end 32 of the projectile 30. In yet another embodiment the annular projection may be formed onto the surface of the front end 32 of the projectile 30 and the annular depression is formed into the interior of the sleeve. In yet another embodiment a magnet is attached to the posterior of the arrowhead 40 and a magnetically attractive material is attached to the front end 32 of the projectile 30. In yet another embodiment a magnetically attractive material is attached to the posterior of the arrowhead 40 and a magnet is attached to the front end 32 of the projectile 30. Other means for frictionally, mechanically, or magnetically attaching the arrowhead 40 to the projectile 30 as are known in the art are also contemplated by the present invention.

Figure 4:
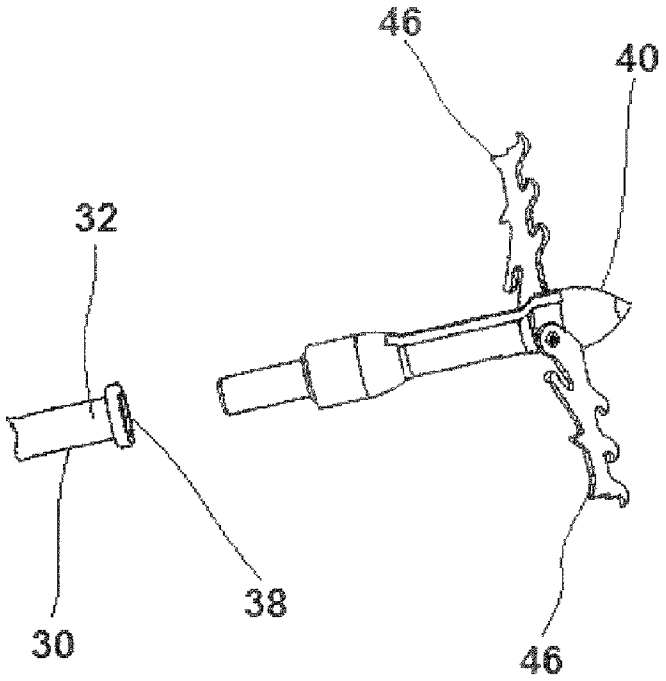
FIG. 4 is an exploded perspective view of an embodiment of the projectile-based system for impeding the escape of a game animal employing retractable grappling arms on the arrowhead.

In further embodiments of the present invention comprising an arrowhead 40, the arrowhead 40 may comprise one or more retractable grappling arms 46 to improve engagement of the environmental engagement device 60 with the environment 20. See FIG. 4. The retractable grappling arms 46 may comprise hooks, barbs, or other projections. Each of the retractable grappling arms 46 has an undeployed state and a deployed state. In the undeployed state, each retractable grappling arm 46 exhibits a relatively low profile to the arrowhead 40. In the deployed state, each retractable grappling arm 46 extends laterally from the arrowhead 40 relative to the undeployed state. The retractable grappling arms 46 are suitably adapted to remain undeployed during the flight of the projectile 30 and to deploy after the arrowhead 40 has passed through the game animal 10. In one embodiment the retractable grappling arms 46 are pivotally attached to the arrowhead 40, whereby inertial forces cause the retractable grappling arms 46 to move from the undeployed state to the deployed state. In another embodiment springs may be used to move the retractable grappling arms 46 from the undeployed state to the deployed state. Other configurations of the retractable grappling arms 46 are also contemplated.

In yet further embodiments of the present invention comprising an arrowhead 40, the arrowhead 40 may comprise one or more non-retractable grappling arms 48 to improve engagement of the environmental engagement device 60 with the environment 20. See FIG. 2. The non-retractable grappling arms 48 may comprise hooks, barbs, or other projections. The non-retractable grappling arms 48 may be integrated with the blades of the arrowhead 40, depending rearward. Other configurations of the non-retractable grappling arms 48 are also contemplated.

In alternative embodiments of the present invention comprising an arrowhead 40, the present invention further comprises a presert 90. See FIG. 3. The presert 90 has a front end 92 and a back end 94 and is suitably adapted to be interposed between the projectile 30 and the arrowhead 40 to removably attach the arrowhead 40 to the projectile 30. The presert 90 may be substantially cylindrical in shape, and manufactured of aluminum, plastic, a composite material, or any other suitable material or combination thereof. The arrowhead 40 is removably attached to the front end 92 of the presert 90 by any of the configurations described above by which the arrowhead 40 is directly attached to the projectile 30, with the front end 92 of the presert 90 having the same modifications as described for the front end 32 of the projectile 30. In these embodiments the back end 94 of the presert 90 is fixedly attached to the front end 32 of the projectile 30. The attachment of the presert 90 to the projectile 30 may be achieved by any suitable means, such use by use of threaded posts and apertures, by use of adhesives, by frictional attachment, and by other means known in the art. As in the case of direct attachment of the arrowhead 40 to the projectile 30, the arrowhead 40 is removed from the presert 90 by inertial forces acting on the arrowhead 40 as the forward motion of the projectile 30 becomes slowed or stopped relative to the forward motion of the arrowhead 40.

In other embodiments comprising an arrowhead 40 and a presert 90, the presert 90 is fixedly attached to the arrowhead 40 and removably attached to the front end 32 of the projectile 30. In all other respects these embodiments are configured as described above, but with the removable attachment configurations applying to the projectile 30 and the presert 90 in the same manner as described above between the presert 90 and the arrowhead 40, respectively, and the fixed attachment configurations applying to the presert 90 and the arrowhead 40 in the same manner as described above between the projectile 30 and the presert 90, respectively. As in the case of direct attachment of the arrowhead 40 to the projectile 30, the arrowhead/presert 40,90 combination is removed from the projectile 30 in these embodiments by inertial forces acting on the arrowhead/presert 40,90 as the forward motion of the projectile 30 becomes slowed or stopped relative to the forward motion of the arrowhead/presert 40,90.

Figure 5:
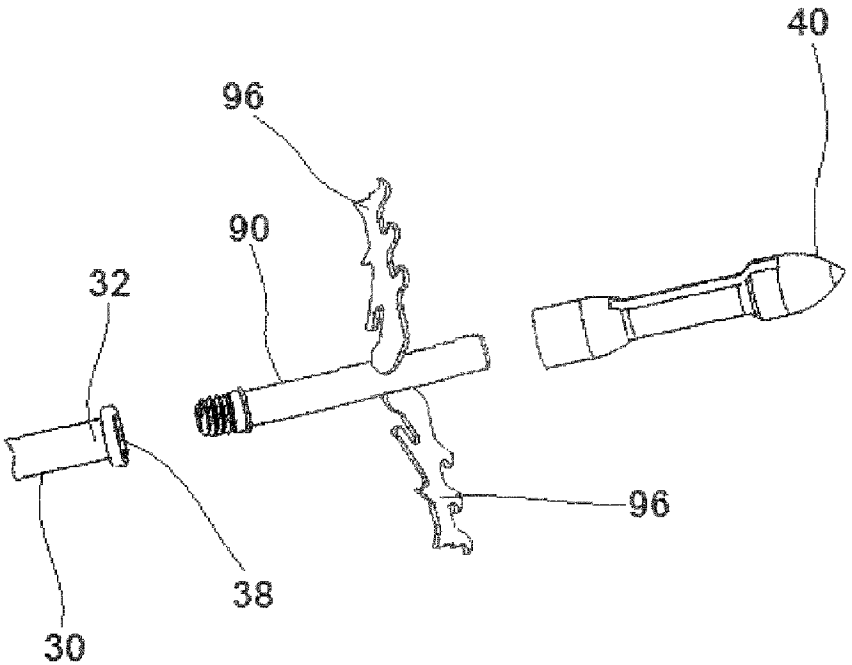
FIG. 5 is an exploded perspective view of the embodiment of the projectile-based system for impeding the escape of a game animal employing retractable grappling arms on the presert.

In yet other embodiments comprising an arrowhead 40 and a presert 90, the presert 90 may comprise one or more retractable grappling arms 96 as described above. See FIG. 5. In yet other embodiments comprising an arrowhead 40 and a presert 90, the presert 90 may comprise one or more non-retractable grappling arms 98 as described above.

In the embodiments of the present invention comprising a detachable nock 50, the detachable nock 50 comprises a nock body 52, a vertical notch to receive a bow string situated at the posterior end of the detachable nock 50, an attachment component 56 situated at the anterior end of the detachable nock 50 for removably attaching the detachable nock 50 to the back end 34 of the projectile 30, and a retention component 58 for securing the detachable nock 50 to the game animal 10. The retention component 58 may be hooks, barbs, fins, plates, disks, or any other type of projection depending from the nock body 52 and which are suitably adapted to engage the game animal 10. In one embodiment the attachment component 56 is a hollow post having a slot along its length, with the tether 80 attached to the inside end of the attachment component 56 and lying within the hollow post. Upon the detachable nock 50 detaching from the projectile 30, the attachment component 56 pivots at its attachment point with the tether 80, causing the tether 80 to exit the slot and the detachable nock 50 to rotate ninety degrees. This movement greatly increases the cross sectional area of the detachable nock 50 and improves the retention capabilities thereof. In an alternative embodiment, the hollow post of the attachment component 56 comprises teeth on either side of the slot, whereby the teeth are suitably adapted to engage with the game animal 10 upon the detachable nock 50 rotating as described above.

In the embodiments of the present invention comprising a detachable nock 50, the detachable nock 50 may be frictionally attached to the back end 34 of the projectile 30, mechanically attached to the back end 34 of the projectile 30, or magnetically attached to the back end 34 of the projectile 30. In any such configuration, the attachment mechanism must be suitably secure to retain the detachable nock 50 to the projectile 30 during the flight of the projectile 30, but must be overcome by the inertial forces acting on the projectile 30 upon the game animal 10 being struck with the projectile 30. In one embodiment, a frictional attachment is achieved by the attachment component 56 of the detachable nock 50 being a post depending from the anterior of the detachable nock 50, said post suitably adapted to be snugly inserted into an aperture located at the back end 34 of the projectile 30. In another embodiment, a frictional attachment is achieved by the attachment component 56 being a sleeve depending from the anterior of the detachable nock 50, said sleeve suitably adapted to snugly fit over the back end 34 of the projectile 30. In yet another embodiment, a mechanical attachment is achieved by the attachment component 56 being a post depending from the anterior of the detachable nock 50, said post suitably adapted to be inserted into an aperture located at the back end 34 of the projectile 30, said post having an annular projection adapted to fit into an annular depression formed within the aperture of the projectile 30. In yet another embodiment the annular projection may be formed within the aperture of the projectile 30 and the annular depression is formed into the post. In yet another embodiment a mechanical attachment is achieved by the attachment component 56 being a sleeve depending from the anterior of the detachable nock 50 as described above with an internal annular projection, adapted to fit into an external annular depression formed in the surface of the back end 34 of the projectile 30. In yet another embodiment the annular projection may be formed onto the surface of the back end 34 of the projectile 30 and the annular depression is formed into the interior of the sleeve. In yet another embodiment a magnet is attached to the attachment component 56 of the detachable nock 50 and a magnetically attractive material is attached to the back end 34 of the projectile 30. In yet another embodiment a magnetically attractive material is attached to the attachment component 56 and a magnet is attached to the back end 34 of the projectile 30. Other means for frictionally, mechanically, or magnetically attaching the detachable nock 50 to the projectile 30 as are known in the art are also contemplated by the present invention.

In yet another embodiment of the present invention, the system 1 comprises a deployable environmental engagement device 60 and a retention device 70, but no tether. The environmental engagement device 60 is fixedly attached to the front end 32 of the projectile 30 and the retention device 70 is fixedly attached to the back end 34 of the projectile 30. The environmental engagement device 60 is deployed upon impact of the retention device 70 with the game animal 10 by inertial forces acting on the environmental engagement device 60. In one embodiment of this variation of the system 1, the environmental engagement device 60 is integrated with the arrowhead 40. In such an embodiment, the arrowhead 40 comprises one or more retractable grappling arms 46, as described above. Inertial forces acting on the projectile 30 upon its striking the game animal 10 cause the one or more grappling arms 46 to deploy, thereby increasing the likelihood of the environmental engagement device 60 engaging with the environment 20.

Modifications and variations may be made to the disclosed embodiments of the present invention without departing from the subject or spirit of the present invention, and other embodiments not specifically set forth herein are also within the scope of the following claims.

We claim:

1. A projectile-based system for impeding the escape of a game animal, comprising an environmental engagement device, a retention device, and a tether, wherein the projectile has a front end and a back end, said projectile being one of the group of an arrow and a cross bow bolt;

the environmental engagement device is suitably adapted to pass through the game animal and thereafter to engage with the environment;

the retention device is suitably adapted to engage with the game animal and become secured thereto; and the tether is suitably adapted to attach the environmental engagement device to the retention device, said tether being suitably adapted to withstand without breaking forces applied by the game animal to said tether in the course of attempting an escape, thereby retaining the game animal to the environmental engagement device;

whereby the engagement of the environmental engagement device with the environment substantially impedes the escape of the game animal.

2. The system of claim 1 wherein the projectile has a hollow shaft and the tether is stored within the hollow shaft prior to deployment.

3. The system of claim 1 further comprising an arrowhead, wherein said arrowhead is removably attached to the front end of the projectile, said removal accomplished by inertial forces acting on said arrowhead as the forward motion of the projectile becomes slowed or stopped relative to the forward motion of the arrowhead;

the environmental engagement device is comprised of the arrowhead and portions of the tether; and the retention device is located at the back end of the projectile;

whereby upon impact of the projectile with the game animal the arrowhead passes through the game animal, the retention device halts the passage of the projectile through the game animal, and inertial forces cause the arrowhead to detach from the projectile, deploying the tether.

4. The system of claim 3 wherein the arrowhead comprises one or more retractable grappling arms, each of said grappling arms having an undeployed state and a deployed state, wherein in the undeployed state each grappling arm exhibits a relatively low profile to the arrowhead, and in the deployed state each grappling arm extends laterally from the arrowhead relative to the undeployed state, with said one or more grappling arms suitably adapted to remain undeployed during flight of the projectile and to deploy after the arrowhead has passed through the game animal.

5. The system of claim 3 wherein the arrowhead comprises one or more non-retractable grappling arms, wherein each said grappling arm is suitably adapted to increase the likelihood of the arrowhead engaging with the environment after the arrowhead has passed through the game animal and separated from the front end of the projectile.

6. The system of claim 1 further comprising a detachable nock, wherein the environmental engagement device comprises portions of the tether and the projectile; and the retention device comprises the detachable nock, said detachable nock being located at the back end of the projectile, wherein said detachable nock is removably attached to the back end of the projectile, said removal accomplished by inertial forces acting on said projectile as the forward motion of the detachable nock becomes slowed or stopped relative to the forward motion of the projectile;

whereby upon impact of the projectile with the game animal the projectile passes completely through the game animal, the detachable nock impacts the game animal and is secured thereto, and inertial forces cause the projectile to detach from the detachable nock, deploying the tether.

7. The system of claim 6 wherein the detachable nock comprises a nock body;

a vertical notch to receive a bow string;

an attachment component situated opposite the vertical notch for removably attaching the detachable nock to the back end of the projectile; and a retention component for securing the detachable nock to the game animal.

8. The system of claim 1 further comprising an arrowhead and a detachable nock, wherein said arrowhead is removably attached to the front end of the projectile, said removal accomplished by inertial forces acting on said arrowhead as the forward motion of the projectile becomes slowed or stopped relative to the forward motion of the arrowhead;

said detachable nock is removably attached to the back end of the projectile, wherein said removal is accomplished by inertial forces acting on said projectile as the forward motion of the detachable nock becomes slowed or stopped relative to the forward motion of the projectile;

the environmental engagement device is comprised of the arrowhead, the projectile, and portions of the tether; and the retention device comprises the detachable nock, said detachable nock being located at the back end of the projectile.

9. The system of claim 1 further comprising a presert and an arrowhead, said presert having a front end and a back end, said presert suitably adapted to removably attach the arrowhead to the projectile, wherein the back end of the presert is fixedly attached to the front end of the projectile and the arrowhead is removably attached to the front end of the presert, said removal accomplished by inertial forces acting on said arrowhead as the forward motion of the projectile becomes slowed or stopped relative to the forward motion of the arrowhead;

the environmental engagement device is comprised of the arrowhead and portions of the tether; and the retention device is located at the back end of the projectile.

10. The system of claim 9 wherein the arrowhead comprises one or more retractable grappling arms, each of said grappling arms having an undeployed state and a deployed state, wherein in the undeployed state each grappling arm exhibits a relatively low profile to the arrowhead, and in the deployed state each grappling arm extends laterally from the arrowhead relative to the undeployed state, with said one or more grappling arms suitably adapted to remain undeployed during flight of the projectile and to deploy after the arrowhead has passed through the game animal.

11. The system of claim 9 wherein the arrowhead comprises one or more non-retractable grappling arms, wherein each said grappling arm is suitably adapted to increase the likelihood of the arrowhead engaging with the environment after the arrowhead has passed through the game animal and separated from the front end of the projectile.

12. The system of claim 1 further comprising a presert and an arrowhead, said presert having a front end and a back end, said presert suitably adapted to removably attach the arrowhead to the projectile, wherein the back end of the presert is removably attached to the front end of the projectile and the arrowhead is fixedly attached to the front end of the presert, said removal accomplished by inertial forces acting on said arrowhead as the forward motion of the projectile becomes slowed or stopped relative to the forward motion of the arrowhead;

the environmental engagement device is comprised of the arrowhead, the presert, and portions of the tether; and the retention device is located at the back end of the projectile.

13. The system of claim 12 wherein the presert comprises one or more retractable grappling arms, each of said grappling arms having an undeployed state and a deployed state, wherein in the undeployed state each grappling arm exhibits a relatively low profile to the presert, and in the deployed state each grappling arm extends laterally from the presert relative to the undeployed state, with said one or more grappling arms suitably adapted to remain undeployed during flight of the projectile and to deploy after the presert has passed through the game animal.

14. The system of claim 12 wherein the presert comprises one or more non-retractable grappling arms, wherein each said grappling arm is suitably adapted to increase the likelihood of the presert engaging with the environment after the presert has passed through the game animal and separated from the front end of the projectile.

15. The system of claim 1 wherein the retention device is comprised of a penetration limiter and the back end of the projectile, with the penetration limiter located at the back end of the projectile.

16. The system of claim 1 wherein the tether has a length that is less than four times the length of the projectile.

17. A projectile-based system for impeding the escape of a game animal, comprising a deployable environmental engagement device, a retention device, and an arrowhead, wherein the projectile has a front end and a back end, said projectile being one of the group of an arrow and a cross bow bolt;

the environmental engagement device comprises the arrowhead and portions of the projectile;

the environmental engagement device is suitably adapted to pass through the game animal and thereafter to deploy and engage with the environment;

the arrowhead comprises one or more retractable grappling arms, each of said grappling arms having an undeployed state and a deployed state, wherein in the undeployed state each grappling arm exhibits a relatively low profile to the arrowhead, and in the deployed state each grappling arm extends laterally from the arrowhead relative to the undeployed state, with said one or more grappling arms suitably adapted to remain undeployed during flight of the projectile and to deploy after the arrowhead has passed through the game animal, and the retention device is suitably adapted to engage with the game animal and become secured thereto;

whereby the engagement of the environmental engagement device with the environment substantially impedes the escape of the game animal.

18. A game animal escape impedance device for use with archery bows or cross bows, comprising:

an elongate projectile with a front end and a back end;

an arrowhead mountable on the front end of the projectile with grappling arms for environmental engagement;

a nock mountable on the back end of the projectile with a blunt force impacting, penetration limiting, and animal retaining projection; and a tether connecting the arrowhead and nock through a hollow shaft in the projectile.

19. The game animal escape impedance device of claim 18 wherein the tether has a length that is less than four times the length of the projectile.

20. The game animal escape impedance device of claim 18 wherein the arrowhead is removably mountable on the projectile;

whereby removal is accomplished by inertial forces acting on the arrowhead as forward motion of the projectile is stopped by the blunt force impacting, penetration limiting, and animal restraining projection.

21. The game animal escape impedance device of claim 18 wherein the nock is removably mountable on the projectile;

whereby removal is accomplished by inertial forces acting on the projectile as forward motion of the nock is stopped by the blunt force impacting, penetration limiting, and animal restraining projection.

* * * * *